United States Patent [19]

Arai

[11] 4,373,438

[45] Feb. 15, 1983

[54] DOT PRINTER

[75] Inventor: Kenichiro Arai, Shiojiri, Japan

[73] Assignees: Shinshu Seiki Kabushiki Kaisha, Nagano; Kabushiki Kaisha Suwa Seikosha, Tokyo, both of Japan

[21] Appl. No.: 219,741

[22] Filed: Dec. 24, 1980

[30] Foreign Application Priority Data

Dec. 28, 1979 [JP] Japan ..... 54-172230

[51] Int. Cl.[3] ..... B41J 3/12

[52] U.S. Cl. ..... 101/93.04; 400/121

[58] Field of Search ..... 400/121, 124; 101/93.04, 93.05, 93.48

[56] References Cited

U.S. PATENT DOCUMENTS

| | | | |
|---|---|---|---|
| 3,934,695 | 1/1976 | Kovalick | 400/124 X |
| 4,077,505 | 3/1978 | Giolitti et al. | 101/93.04 X |
| 4,137,513 | 1/1979 | Reece | 400/124 X |
| 4,285,603 | 8/1981 | Bernardis et al. | 101/93.05 X |

FOREIGN PATENT DOCUMENTS

| | | | |
|---|---|---|---|
| 589134 | 1/1978 | U.S.S.R. | 400/121 |

*Primary Examiner*—Paul T. Sewell

*Attorney, Agent, or Firm*—Blum, Kaplan, Friedman, Silberman and Beran

[57] ABSTRACT

A rounded end on a pivoted arm impacts a print medium through an ink ribbon to form a printed dot on the print medium. For printing, a wire drawn by an electromagnet acts on the arm between the pivot axis and the rounded end. A plurality of arms and electromagnets are spaced apart along a lateral row and mounted on a carriage for reciprocal lateral translation over a distance approximating the space between arms to print an entire horizontal row of dots forming a portion of a character line. Arms are driven separately or in combinations. The gap in the electromagnet is simply fixed to reduce power requirements.

17 Claims, 6 Drawing Figures

PRINT DATA INPUT
PRINT SIGNAL GENERATOR

H
1
2
3
4
5
6
7
8
11
15
16
18
19-1
19-2
19-3
19-4
20
22
25
30
31
31a

DOT PRINTER

BACKGROUND OF THE INVENTION

This invention relates generally to a dot printer of the type used in miniaturized printers, and more particularly, to a printer suited to a matrix type output. In recent years, electric calculators have been made in remarkably small sizes as a result of improvement in mounting technology. In particular, great contributions have been made through increased density and the reduction of power consumption through large scale integration (LSI) of circuits, thinning and reduction in power consumption of the liquid crystal display means which are generally used, and simplifications in the keyboard.

With regard to an electric calculator equipped with a printer, suitable progress in miniaturization and power consumption reduction of the printer makes it possible to produce a convenient electric calculator with printer which is entirely portable when driven by means of an internal battery. However, because printing is accomplished by means of a print character ring of a printing character drum provided with raised characters on the outer peripheries, it is not possible to print more than the characters and signs that are already present on the rings or drums. Accordingly use of the printer is extremely limited. Therefore, a dot printer of ultra-small size and having a lower power consumption, which can print characters, signs and graphics very freely by means of a dot matrix, is desirable. Presently, various types of dot printers are in use or proposed. However, most of these dot printers are complicated in construction and large in size. Further, they require a high voltage for driving and consume substantial quantities of electrical power. Thus, they are not suitable for a convenient hand held or portable electric calculator with printer.

For example, in a conventional wire dot printer, which prints by means of a plurality of wires, an electromagnet having a hinge action or a plunger action is used as a driving power source which reciprocates the wires. In a printer using a plunger-type electromagnet, a wire is directly fixed on a plunger. The plunger is drawn into a hollow portion of the coil so that the attached wire goes in and out with the plunger. In this design, the gap between the platen for printing and the tip of the wire is no more or less than the stroke of the plunger. Because inadvertent contact between the ribbon and paper must be avoided, the stroke must be long and the gap between the plunger is large. The attractive force of the electromagnet is provided only with high inputs of electrical energy. Accordingly, electrical efficiency of the electromagnet is extremely poor and high voltage and high current are necessary for driving the wire in a short period of time measured in microseconds.

On the other hand, in a printer using a hinged-type electromagnet, the wire is extended out from a hinge beyond the electromagnet. Then it is possible to make the gap in the electromagnet smaller than the gap between the platen and the end of the wire. But the drawing power of the electromagnet in a printer of this type is less than the drawing power in a printer using a plunger-type electromagnet where the plunger is drawn into a hollow portion of the coil. Again, efficiency of the electromagnet is extremely poor and high voltage and high current are again necessary for a printer using a hinge-type electromagnet construction. Both of these printers are constructed where the impacting ends of a plurality of wires are arranged in a row. As a result, the structure is complicated and large as well as inefficient.

Controlling the stroke of the wire, that is, the gap in the electromagnet, by means of screws and the like, or not controlling the gap at all, presents difficulties. In the first instance, the cost of production is raised, and in the second instance, a large current is necessary for driving because suitable printing must be assured regardless of the variations in the gap. Also, it should be understood that when simultaneously driving a plurality of wires, the peak current drain is very large and the use of batteries is disadvantageous either through incapacity to deliver sufficient current or short operating life.

What is needed is a dot printer which is small in size, simple in construction, reliable, and uses low electrical energy while producing high quality printing.

SUMMARY OF THE INVENTION

Generally speaking, in accordance with the invention, a dot printer especially suitable for portable electric calculators is provided. A rounded end on a pivoted arm impacts a print medium through an ink ribbon to form a printed dot on the print medium. For printing, a wire drawn by an electromagnet acts on the arm between the pivot axis and the rounded end. A plurality of arms and electromagnets are spaced apart along a lateral row and mounted on a carriage for reciprocal lateral translation of a distance approximating the space between arms to print an entire horizontal row of dots forming a portion of a printed character line. Arms print separately or in combinations and the carriage advances after every arm action. After a horizontal line of dots is printed, the carriage translates back to its initial position and the print medium is moved so that the next vertical row of dots may be printed.

The gap in the electromagnet is simply fixed to reduce power requirements by providing a fixed relationship between the moving element and the stationary coil at the standby condition. Power is also reduced because generally only one arm is actuated at a time in an alternating pattern and also a quick return of the arm is not a necessity.

Accordingly, it is an object of this invention to provide an improved dot printer which can be combined with an extremely small hand electric calculator as a portable combination.

Another object of this invention is to provide an improved dot printer operating on low voltage and low power because of electromagnetics having good efficiency by means of an extremely small gap between a plunger and a fixed coil core.

A further object of this invention is to provide an improved dot printer having highly efficient electromagnets with high absorption force of a plunger-type and also an enlarged stroke for impact by means of a print lever.

Still another object of this invention is to provide a dot printer of good efficiency wherein variation in the gap of the electromagnets is made extremely small and the maximum gap between the plunger and a fixed coil core is established.

Yet another object of this invention is to provide an improved dot printer wherein maximum current drain is reduced by printing with a few printing arms reciprocated along the width of the print medium, and energizing each arm in sequence.

A further object of this invention is to provide an improved dot printer for a matrix printing of characters incorporating the printing arms and the associated electromagnets on the same movable carriage.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figures 1, 6:
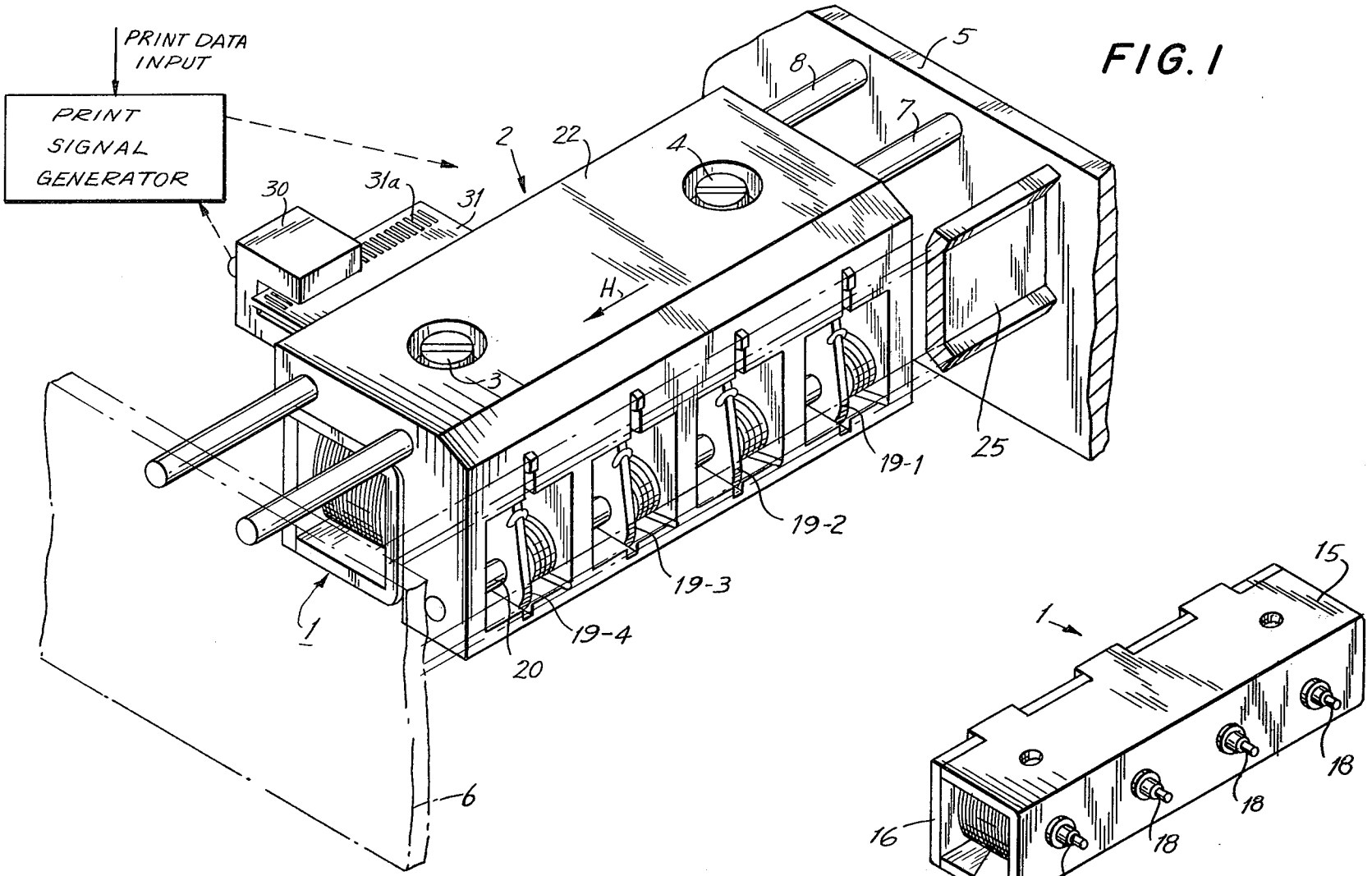
FIG. 1 is a top front perspective view of a dot printer mechanism in accordance with this invention.
FIG. 6 is a top perspective view of an electromagnet assembly of the printer mechanism of FIG. 1.

With reference to FIGS. 1 and 6, the dot printing mechanism in accordance with this invention includes an electromagnet unit 1 and a carriage unit 2 with the electromagnet unit 1 being fixed on the carriage unit 2 by means of screws 3, 4. The carriage unit 2 is mounted for reciprocal motion on shafts 7, 8 in the direction of the arrow H and in the reverse direction. The shafts 7, 8 are mounted between frames 5, 6.

Figure 2:
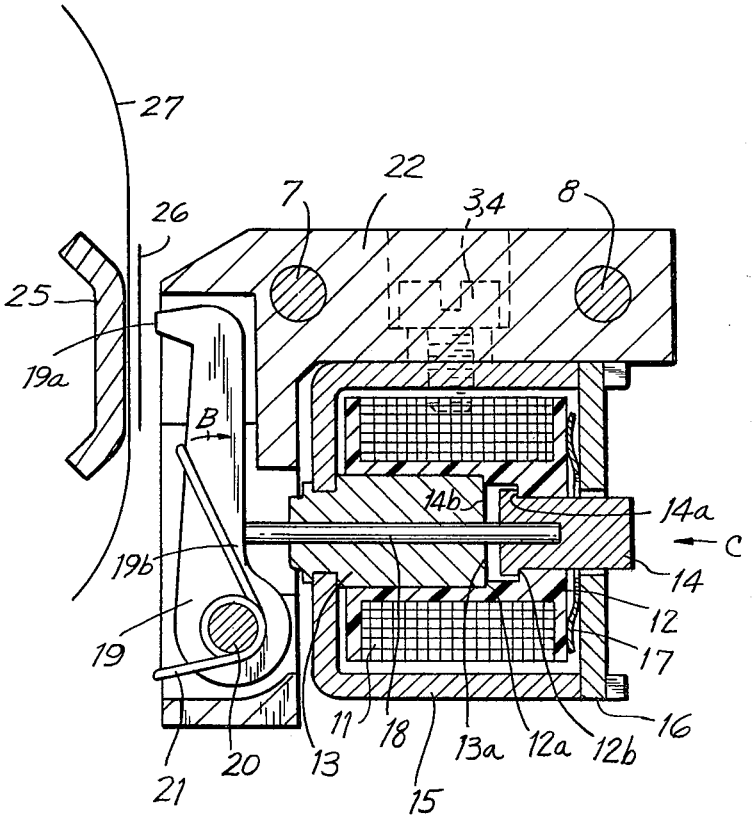
FIG. 2 is a sectional view of the dot printer mechanism of FIG. 1.

In the illustrated exemplary embodiment four sets of electromagnets and printing arms as explained more fully hereinafter are positioned at regular intervals on the electromagnet unit 1 and carriage unit 2. FIG. 2 is a sectional view of one of the electromagnet and printing arm assemblies. An electromagnet comprises a U-shaped yoke 15, a fixed cylindrical coil core 13 fixedly attached at one end to the yoke 15, a magnetic plunger 14 disposed on the same axis as the fixed coil core 13. The plunger 14 has a step surface or shoulder **14*a*. A yoke 16 engages the yoke 15 for completing the magnetic circuit, and a coil 11 is wound around a coil frame 12 which is mounted on the coil core 13 and is coaxial therewith. The coil frame 12 includes two step surfaces on its inner periphery, one step surface 12*a* being pressed against the back face 13*a* of the fixed coil core 13. A holder spring 17 located between the yoke 16 and the coil frame 12 urges the frame 12 into the aforementioned contact with the surface 13*a*. The other step surface 12*b* of the coil frame 12 acts as a stop for the plunger 14 in the direction away from the fixed core 13. The surface 12*b* of the coil frame 12 is pressed upon by the step surface 14*a* of the plunger 14 as described more fully hereinafter. A rod or wire 18 passes through the center of the fixed coil core 13 and is fixedly attached in a recess in the plunger 14. When the coil 11 is electrically excited, the fixed coil core 13, plunger 14, yoke 16 and yoke 15** are all activated as part of the magnetic circuit.

A printing lever or arm 19, having a striking surface **19*a*, is supported to move pivotably on a shaft 20 provided on a carriage frame 22. A biasing force is applied to the printing lever 19 in the direction of the arrow B by a return spring 21. The carriage frame 22 is contoured so that the wire 18 engages the printing lever 19 on a surface portion 19*b* between the striking surface 19*a* and the shaft 20. Thus, the striking surface 19*a* moves a greater distance than does the wire 18**.

A platen 25, fabricated of a hard material such as metal, is positioned in registry with the striking surface **19*a* with an ink ribbon 26 and a printing paper 27 being located between the platen 25 and print lever 19**.

When the coil 11 is not electrically excited, the printing lever 19, wire 18 and plunger 14 are in a rest position, that is, in a state where the step surface **14*a* of the plunger 14 is pressed against the stop step surface 12*b* of the coil frame 12. The force produced in the direction B by the spring 21 assures that the plunger 14 presses against the stop surface 12*b*. At this time, the force of the pressure spring 17 holding the coil frame 12 against the coil core 13 at the step surface 12*a*, is much greater than the force exerted by the return spring 21. Accordingly, the rest position is as illustrated in FIG. 2 with the coil frame 12 firmly located against the core 13 and with the plunger 14 firmly located against the coil frame 12. Thus, a fixed relationship exists which establishes the size of the gap between the fixed core 13 and the movable plunger 14** when the magnet is de-energized.

When the coil 11 is electrically excited, the plunger 14 is attracted in the direction of the arrow C so that the wire 18 pushes and rotates the printing lever 19 about the shaft 20 in a direction opposite to that indicated by the arrow B. When the printing lever 19 pivots, the striking surface **19*a* strikes the platen 25 strongly through the ink ribbon 26 and the printing paper 27 so that a point or dot of the same size and shape as the striking surface 19*a* is printed on the paper 27. The striking surface 19*a* is round such that round dots are printed in this exemplary embodiment. The ratio of the stroke length of the striking surface 19*a* to the stroke length of the plunger 14 is the same as the ratio of the distances of the striking surface 19*a* and the wire 18 to the pivot axis of the shaft 20. Therefore, the stroke of the striking surface 19*a* of the printing lever 19 can be made sufficiently long and the stroke of the plunger 14** can be reduced as much as possible.

Because the attractive force of a plunger-type electromagnet as described here is in inverse proportion to the square of the gap, here, also the stroke distance, it is necessary that the gap be made as small as possible in order to achieve a large attractive force with a small magnetomotive force, that is, using low voltage and low power consumption. On the other hand, it is necessary that the space between the striking surface **19*a* and the platen 25 should be made as large as possible taking into consideration the interposition of the ink ribbon 26 and the printing paper 27. It is not desirable that there be inadvertent contact between these elements when printing is not actually being implemented. The construction in accordance with this invention adequately satisfies both requirements for a long stroke at the striking surface 19*a* and a short stroke of the plunger 14**.

Further, by providing the striking surface 19*a* at the end of the printing lever 19, the size of the dot to be printed, and for that matter, the shape of the dot, can be very freely elected, especially when compared with a printer where the dots are actually produced by the wire itself. As described above, the gap between the fixed iron core 13 and the movable plunger 14 in the resting state is determined only by two factors, namely, the distance between the step surfaces 12*a*, 12*b* of the coil frame 12 and the distance between the step surface 14*a* and the face 14*b* of the movable plunger 14. Therefore, in manufacturing, close tolerance and accuracy is required in only two elements of the electromagnet and a gap of little variation is readily and simply produced.

When there are large variations in the gap in the magnetic circuit of a printer, it is necessary to have as a minimum, sufficient energy available to the coil 11 to provide adequate attractive force when the gap is at a maximum so as to print effectively. In a construction in accordance with this invention however, variations in the gap are small because the critical factors and dimensions are only in two elements and it is possible to substantially reduce the surplus of energy available for input to the coil 11. That is, a battery operated micro dot printer for use with a small electric calculator and having low voltage and low power requirements, is produced by making the gap between the fixed coil core 13 and the plunger 14 as small as possible. Thereby, a great attractive force is obtained from a small magnetomotive force and little excess energy need be supplied to the coil 11 when there is little variation in the gap.

Figure 3:
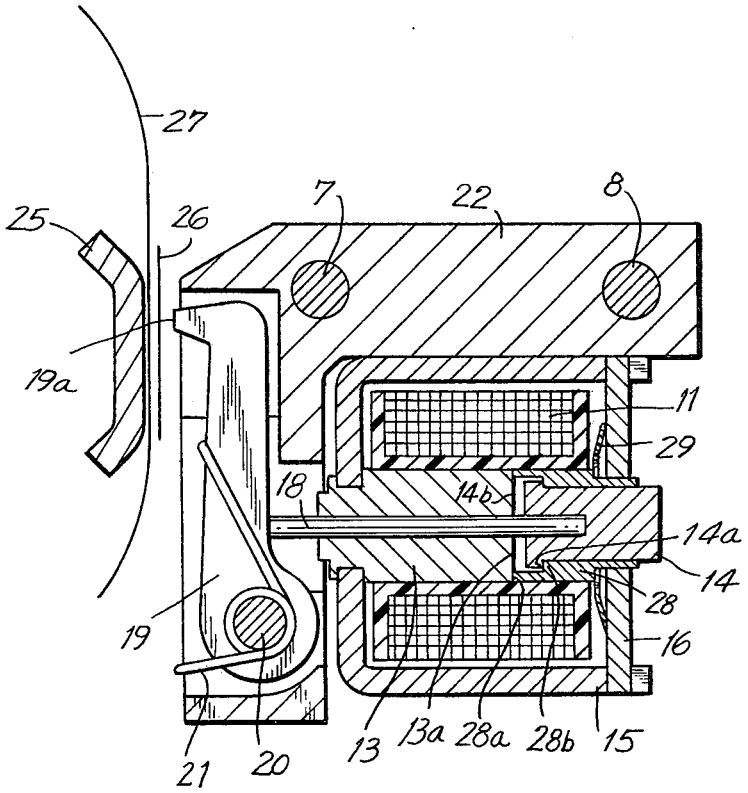
FIG. 3 is a view similar to FIG. 2 showing an alternative embodiment of a dot printer mechanism in accordance with this invention.

In an alternative embodiment as shown in FIG. 3, steps are not provided on a coil frame as described above. The same results of fixing the gap are achieved by providing a plunger guide 28 resting on a peripheral portion of the attractive face surface 13*a* of the fixed coil core 13 by pressure exerted by a spring 29. There is, a stop step surface 28*b* on the inside of the frame plate 28 for engaging the step surface 14*a* of the plunger 14. With these exceptions, the constructions in FIGS. 2 and 3 and their operations are similar. Again, the plunger 14 set off a fixed distance from the fixed core 13 when the mechanism is in a rest or standby condition.

Figure 4:
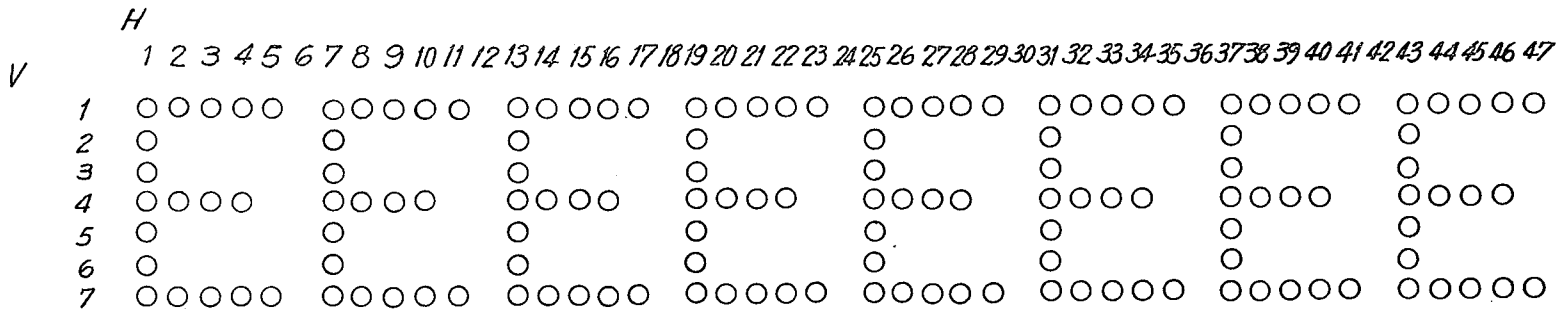
FIG. 4 shows the characters, to an enlarged scale printed by a dot printer in accordance with this invention.

The printing operation is now explained using an example where eight characters "E" as shown in FIG. 4 are printed using a printing system as illustrated in FIG. 1, wherein four sets of printing levers 19 and electromagnets are positioned at slightly irregular intervals in a line between the side frames 5,6 and mounted on a carriage 22 for translation on the shafts 7,8. In this example, each character E is formed on a dot matrix of five by seven dots and the printed characters are separated by an interval of one dot. Thus, forty-seven lateral positions H are required to print eight characters with a space in between each character, and seven vertical positions V are used.

The electromagnet unit 1 of FIG. 1 includes four sets of electromagnets (FIGS. 2,3) at substantially regular intervals. However, as seen in FIG. 6, the U-shaped yoke 15 and plain yoke 16 of the magnetic circuits are common to all four sets of electromagnets. This combined yoke 15, 16 is attached by bolts 3,4 to the carriage frame 22. The carriage frame 22 is reciprocated by a cam (not shown) in the direction indicated by the arrow H for a distance which will include two printed characters that is, as seen in FIG. 4, the carriage translates over a distance from position 1 to at least position 11. Of course, the carriage 22 moves in the reverse direction back to the initial position for printing on the next line. For convenience in explanation, the printing levers 19 associated with the four electromagnets are herein identified as printing levers 19-1, 19-2, 19-3 and 19-4 as shown in FIG. 1. Thus, the printing lever 19-1 always moves reciprocatingly in a lateral range of positions H=1 to H=11. Further, the electromagnet associated with the lever 19-1 will be identified as electromagnet M1, etc. When each printing lever is to print two characters of eight to be printed, printer lever 19-1 moves reciprocatingly in a range of positions from H=1 to approximately H=11; printing lever 19-2 moves in an approximate range of H=13 to H=23; printing lever 19-3 moves in an approximate range of positions from H=25 to H=35; and printing lever 19-4 moves in the approximate range of positions from H=37 to H=47.

The magnetic unit 1 is constructed so that when the printing lever 19-1 is in registry with the position H=1, the printing lever 19-2 is shifted from a position of registry with the position H=13 by $\frac{1}{4}$ of the center distance or pitch between dots. The printing lever 19-3 is shifted from the position H=25 by 2/4 of dot pitch distance, and the printing lever 19-4 is shifted from a position of registry with the position H=37 by $\frac{3}{4}$ of dot pitch distance. The shift from registry is in a direction opposite to the arrow H indicated in FIG. 1.

A light detector 30 comprises light emitting and receiving elements (not shown) which produce timing pulses synchronized with the movement of the carriage 22 in accordance with the presence of slits 31*a* on a slit plate 31 fixed to and moving with the carriage 22. The slits 31*a* of the slit plate 31 are spaced apart to produce four timing pulses when the carriage translates by a distance equal to the pitch of the dots of the character to be printed, for example, four pulses when the carriage travels the distance between positions H=2 and H=3. Further, forty-four timing pulses are produced when the carriage moves a distance such that each print lever 19 produces dots for two characters. The timing pulses T are shown in FIG. 5.

Figure 5:
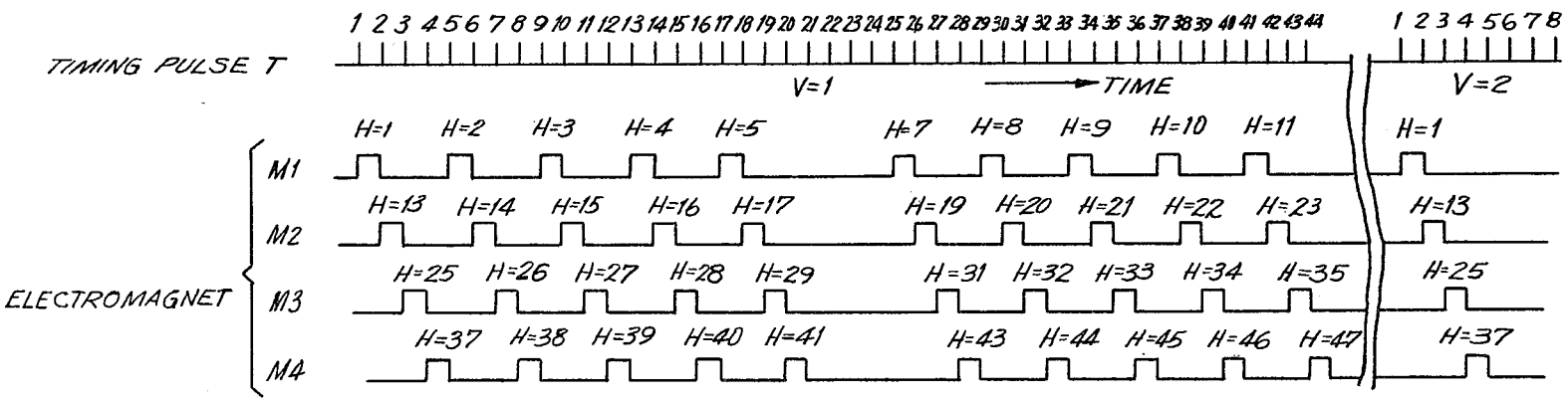
FIG. 5 is a timing chart showing signals for actuation of the printer mechanism of FIG. 1.

Printing operation is now described in conjunction with the timing chart of FIG. 5. First, as the carriage 22 moves in the direction of the arrow H and the printing lever 19-1 is situated in registry with the position H=1 in FIG. 4, a timing pulse T1 is generated by the position detector 30, 31 signal and the electromagnet M1 associated with the printing lever 19-1 is electrically energized. The printing lever 19-1 pivots and a dot having the coordinates H=1 and V=1 is printed. When the carriage 22 moves $\frac{1}{4}$ of the dot pitch distance the timing pulse T2 is generated. At this moment, the printing lever 19-2 is positioned in registry with the position H=13 because, as stated above, it was originally displaced by $\frac{1}{4}$ of the center distance between dots. Then, the electromagnet M2, associated with the printing lever 19-2 is electrically energized and the printing lever 19-2 prints a point having the coordinates H=13 and V=1. When the carriage 22 moves an additional $\frac{1}{4}$ pitch distance between dots, a timing pulse T3 is generated and the electromagnet M3 associated with the printing lever 19-3, now located exactly in registry with the position H=25 is driven so that a dot is printed at the coordinates H=25 and V=1. When the carriage 22 is moved another $\frac{1}{4}$ pitch distance between dots, a timing pulse T4 is generated and the printing lever 19-4 is in registry with the position H=37. When the electromagnet M4 is then electrically energized, a dot is printed at the coordinates H=37 and V=1.

When the carriage 22 moves another ¼ pitch distance between dots, a timing pulse T5 is generated and the printing lever 19-1 is in registry with the position H=2. When the electromagnet M1 is electrically energized again, a dot where H=2 and V=1 is printed. To print a line, designated as V=1, the above-described operations are repeated sequentially to the position H=47 with energization of one electromagnet at every position except when an electromagnet is in registry with the positions H=6,12,18 . . . 42 which represent the spaces between the characters E. After completion of the printing operation at the location where H=47 and V=1, the carriage 22 moves in the direction opposite to the arrow H and returns to a position where the printing lever 19-1 again corresponds with location where H=1. While the carriage 22 returns, the printing paper 27 is advanced by one vertical dot pitch distance from V=1 to V=2.

Eight characters E is shown in FIG. 4 are printed by repeating the above-described operations from V=2 to V=7 and controlling the energization of the magnets M1 to M4. FIG. 4 indicates the signals for the first horizontal row V=1 and the beginning of the second horizontal row V=2.

In summary, printing levers are driven sequentially, one-by-one and the maximum current drawn from the power supply at the time of printing is the maximum current drawn by one electromagnet. In a battery operated printer, such an operational factor is extremely important because the voltage drop caused by the internal impedance of the battery can be limited to the maximum allowable and the maximum current which is drawn is limited to preserve the life of the battery.

Further, with reference to each electromagnet and associated printing lever 19, sufficient time is available to return the printing lever 19 to the rest or standby position after energization of the electromagnet and printing, because each electromagnet is electrically energized only once in every four printing operations. As a result, it is possible to weaken the strength of the return spring 21 acting on the printing lever 19, and accordingly, the pulling force of the electromagnet can be reduced since it does not have to overcome as much force when attracting the moving plunger 14. As a result, power consumption is reduced. Printing speed is not reduced or slow because while one electromagnet and printing lever returns to the rest position, another electromagnet is driven and prints. Further, the device is thin because printing levers and electromagnets are positioned in linear array. Because the electromagnet unit 1 is an integral body as shown in FIG. 6, and is mounted on the carriage 22 with the bolts 3, 4, the space between the striking surface 19*a* of the printing levers 19 and the platen 25 can be controlled very easily by moving the electromagnet unit forward and back.

In the description above, an example of printing eight characters E is presented. It should be understood that the locations between characters, that is, at positions, H=6, 12, 18, 24, 36 and 42, can also be printed with dots. Also, printing in the vertical or V direction is not limited to seven horizontal rows of dots, and accordingly, characters, graphics, etc., of all sizes can be printed. Moreover, instead of actuating four levers 19 for sequential printing, one-by-one, the four printing levers may be actuated in pairs, two-by-two. It will be apparent, that the number of printing levers and electromagnets in a row may be more or less than the four which are illustrated in the embodiment described above.

As stated above, the dot printer in accordance with this invention provides electromagnets which are driven with a low voltage and operate at high efficiency and with low power consumption using a battery. The gap between the moving plunger and the fixed core is made small by amplifying the stroke of the plunger-type electromagnet. Variations in gap dimensions of each electromagnet are made extremely small by a construction for determining the maximum gap between the plunger and the fixed coil using step surfaces on the inside of the electromagnet coil frame. The dot printer in accordance with this invention is extremely thin and low priced, and accordingly, suitable for a small portable electric calculator. The maximum current drained for the printer is made small by using a plurality of electromagnets arranged laterally in a line at right angles to the direction in which the paper is fed, and by reciprocating the electromagnets across the printing paper and activating each electromagnet in sequence.

Portions of a dot printer which are not a novel part of this invention have not been illustrated or described herein. For example, a signal generator, which in coordination with the timing pulses, output signals as shown in FIG. 5 to each electromagnet so as to form the desired character, whether it is a letter such as the illustrated E or some other letter or symbol is well known and not described herein. Motor means for causing the carriage 22 to translate reciprocatingly on the shaft 7, 8 also are not shown or described and many constructions to accomplish this result will be apparent to those skilled in the art. It should also be apparent that although in the description above the letters are formed from left to right, it will be possible to print from right to left and in both directions with only minor modifications in the signal generating circuits cooperating with the timing pulses.

It will thus be seen that the objects set forth above, among those made apparent from the preceding description, are efficiently attained and, since certain changes may be made in the above constructions without departing from the spirit and scope of the invention, it is intended that all matter contained in the above-description or shown in the accompanying drawings shall be interpreted as illustrative and not in a limiting sense.

It is also to be understood that the following claims are intended to cover all the generic and specific features of the invention herein described, and all statements of the scope of the invention which, as a matter of language, might be said to fall therebetween.

What is claimed is:

1. A dot printer for printing on a recording media using a matrix of dots comprising:

a carriage, said carriage being supported for reciprocal motion in a lateral direction;

at least one printing lever, each printing lever including a printing surface for impacting said medium for printing, and a bearing surface, said at least one printing lever being pivotably mounted and connected to said carriage for lateral movement therewith;

electromagnetic means associated with each said at least one printing lever, each said electromagnetic means including a movable plunger, a wire connected at one end to said plunger for movement therewith, the other end of said wire engaging said bearing surface of said printing lever, a coil frame having a coil core and a coil mounted thereon, energization of said electromagnetic means causing said movable plunger to be attracted to said coil core, said printing means pivoting and impacting said printing surface against said printing medium, said electromagnetic means being mounted on said carriage and moving therewith;

individual spring means associated with each said at least one printing lever, one end of said spring means being connected to said carriage, the other end of each said spring means being connected to one of said at least one printing levers and biasing said printing lever in a position away from said recording medium, said wire operating in opposition to said spring means when said electromagnetic means is energized, printing of said medium being done at a plurality of lateral positions.

2. A dot printer as claimed in claim 1, wherein the number of said printing levers is at least two, said printing levers being spaced apart in said lateral direction.

3. A dot printer as claimed in claim 2, wherein said recording medium is mounted parallel to said lateral direction and moves perpendicularly to said lateral direction, whereby progressive lines of print can be formed on said recording medium.

4. A dot printer as claimed in claim 3, wherein the number of printing levers is greater than two and the lateral spacing between adjacent printing means is uniform.

5. A dot printer as claimed in claim 2 or 4, and further comprising means for generating signals to energize said electromagnetic means.

6. A dot printer as claimed in claim 5, wherein said carriage is adapted to translate regularly in said lateral direction relative to said recording medium, whereby a continuous line of uniformly spaced impacts may be made against said recording medium.

7. A dot printer as claimed in claim 5, and further comprising means for detecting the lateral position of said carriage relative to said recording medium.

8. A dot printer as claimed in claim 1, wherein said electromagnetic means associated with each said at least one printing lever further includes:

guide means for constraining the motion of said plunger; and said fixed core is positioned within said coil and frame and said wire passes through said fixed core.

9. A dot printer as claimed in claim 8, wherein location of said contact by said wire on said printing lever is such that the stroke of said printing surface when said wire moves is greater than the distance moved by said plunger toward said fixed core.

10. A dot printer as claimed in claim 8 or 9, wherein said guide means includes first and second engaging portions for determining the attractive stroke of said plunger.

11. A dot printer as claimed in claim 10, wherein a portion of said fixed core engages said first engaging portion of said guide means.

12. A dot printer as claimed in claim 11, wherein said plunger includes an engaging portion, said plunger engaging portion engages with said second engaging portion of said guide means.

13. A dot printer as claimed in claim 12, wherein said engagement between said plunger and said guide means limits the distance of said plunger from said fixed core.

14. A dot printer as claimed in claim 13, wherein said engaging portions are shoulders oriented transversely to the direction of motion of said plunger.

15. A dot printer as claimed in claim 8, wherein said coil, coil frame, fixed core, movable plunger and wire are positioned coaxially, said plunger moving along the axis of said wire.

16. A dot printer as claimed in claim 8, wherein said guide means are an integral portion of said coil frame.

17. A dot printer as claimed in claim 10, wherein said guide means are an integral part of said coil frame.

* * * * *